US006048292A

United States Patent [19]

Gasquez

[11] Patent Number: 6,048,292

[45] Date of Patent: Apr. 11, 2000

[54] COMBINATION ARM EXERCISE APPARATUS AND PROPULSION AID FOR A WHEELCHAIR

[76] Inventor: Marcus R. Gasquez, 5500 Friendship Blvd., 1925 N, Chevy Chase, Md. 20815

[21] Appl. No.: 09/189,858

[22] Filed: Nov. 12, 1998

[51] Int. Cl.[7] ..... A63B 21/04; A63B 23/12; A61G 5/10

[52] U.S. Cl. ..... 482/130; 482/124; 482/904; 280/304.1

[58] Field of Search ..... 482/123, 124, 482/129, 130, 904; 280/304.1

[56] References Cited

U.S. PATENT DOCUMENTS

| | | | |
|---|---|---|---|
| 3,677,543 | 7/1972 | Richardson | 482/129 |
| 4,153,244 | 5/1979 | Tauber, Jr. . | |
| 4,373,716 | 2/1983 | Pagani | 482/130 |
| 4,544,155 | 10/1985 | Wallenbrock et al. | 482/129 |
| 4,869,494 | 9/1989 | Lambert, Sr. . | |
| 4,911,435 | 3/1990 | Johns . | |
| 4,913,423 | 4/1990 | Farran et al. . | |
| 5,048,825 | 9/1991 | Kelly . | |
| 5,048,827 | 9/1991 | Caruso . | |
| 5,242,179 | 9/1993 | Beddome et al. . | |
| 5,263,916 | 11/1993 | Bobich | 482/124 |
| 5,303,945 | 4/1994 | Oxford . | |
| 5,308,302 | 5/1994 | Miller . | |
| 5,352,174 | 10/1994 | Mason . | |
| 5,362,295 | 11/1994 | Nurge | 482/124 |
| 5,476,431 | 12/1995 | Wilkinson et al. | 482/130 |
| 5,518,486 | 5/1996 | Sheeler | 482/129 |
| 5,597,148 | 1/1997 | Gospodarich . | |
| 5,651,558 | 7/1997 | Boyce . | |
| 5,709,636 | 1/1998 | Vallone et al. | 482/129 |

FOREIGN PATENT DOCUMENTS

| | | |
|---|---|---|
| 2205284 | 12/1988 | United Kingdom . |
| WO 93/02910 | 2/1993 | WIPO . |

*Primary Examiner*—Richard J. Apley
*Assistant Examiner*—Victor Hwang
*Attorney, Agent, or Firm*—Richard C. Litman

[57] ABSTRACT

The invention is combination arm exercise apparatus and propulsion aid for a wheelchair. Typically, a wheelchair user pushes a wheelchair using the triceps, pectorals, and deltoids, exercising these muscle groups extensively without exercising the opposing muscle groups: the biceps, the trapezius, and the latissimus dorsi. The invention is an elastomeric member connected at one end to a strap around the user's wrist, and at the other end to a pivoting arm attached above the footrest of a wheelchair. The invention exercises the biceps, the trapezius, and the latissimus dorsi when stretched, and assists the triceps, pectorals, and deltoids in pushing the wheelchair forward as it retracts. The invention hereby balances the level of exercise for the opposing muscle groups as it helps move the wheelchair forward.

19 Claims, 4 Drawing Sheets

COMBINATION ARM EXERCISE APPARATUS AND PROPULSION AID FOR A WHEELCHAIR

BACKGROUND OF THE INVENTION

1. Field of the Invention

The present invention relates to exercise equipment. More specifically, the invention is an arm exercise apparatus for a wheelchair. The invention is a length of surgical tubing attached at one end to a wrist strap, and at the other end to a swing arm assembly attached above the footrest of a wheelchair.

2. Description of the Related Art

The problem of providing a proper means of exercise for people confined to wheelchairs has attracted the attention of many other inventors. Although several solutions to this problem have been proposed, no invention known to the current inventor takes advantage of the propulsion of the wheelchair itself as a form of exercise while also minimizing the dimensions of the apparatus to a sufficiently small size so that it does not impair the usual use of the wheelchair. Additionally, other inventions fail to address the need to balance the extent to which opposing muscle groups are exercised.

At least three prior inventors have proposed propulsion systems for wheelchairs. The first, U.S. Pat. No. 5,242,179, issued to David W. Beddome et al., describes a wheelchair attachment for the front of a wheelchair, having both arm levers and foot pedals, and functioning as both an exercise mechanism and a propulsion mechanism. The second, U.S. Pat. No. 5,305,945, issued to Stuart G. Oxford, describes a wheelchair drive mechanism comprising a flexible, inverted U-shaped bar attached at each end to a rear wheel by a ratchet mechanism. Lastly, International Pat. App. No. WO 93/02910 describes a propulsion system for a wheelchair comprising a push bar 18 connected through a ratchet to the rear wheels. All three inventions add enough bulk to the wheelchair to interfere with other tasks, and additionally fail to provide balanced exercise to opposing muscle groups.

Several inventors have proposed stationary exercise equipment for use by people in wheelchairs. One example is U.S. Pat. No. 4,135,244, issued to Carl F. Tauber, Jr., describing a gymnastic set for wheelchair patients comprising a frame surrounding the wheelchair, having arm and leg exercising bars in front of the wheelchair, and arm exercising apparatus above and on either side of the wheelchair. This invention requires an able-bodied person to set up the frame around the wheelchair.

U.S. Pat. No. 4,689,494, issued to Theodore E. Lambert, Sr., describes an exercise apparatus for the handicapped comprising a pair of rocker arms having handgrips at one end and foot rests on the other, powered by a motor to provide passive/resistive motion of the arms and legs. Although good stationary exercise is provided, this patent does not disclose any means of balancing the exercise of various opposing muscle groups while pushing the wheelchair.

U.S. Pat. No. 4,911,435, issued to George A. Johns, describes various modifications to various exercise machines having weight and pulley type resistance mechanisms so that a wheelchair may be positioned to allow its occupant to use the machines. This patent does not disclose any means of balancing the exercise of various opposing muscle groups while pushing the wheelchair.

U.S. Pat. No. 5,048,825, issued to Peggy L. Kelly, describes a weight and pulley system which clamps to a door frame or a vertical frame above a wheelchair. This patent does not disclose any means of balancing the exercise of various opposing muscle groups while pushing the wheelchair.

U.S. Pat. No. 5,048,827, issued to Anthony A. Caruso, describes a rowing machine having a U-shaped base resting on the floor, so that a wheelchair can roll into the machine. The wheelchair's rear wheels sit on top of plates attached to the base, holding the machine in place. This patent does not disclose any means of balancing the exercise of various opposing muscle groups while pushing the wheelchair.

U.S. Pat. No. 4,913,423, issued to Mitchell R. Farran et al., describes a chair or sofa having the appearance of conventional furniture, and having a spring and pulley type resistance mechanism for exercise.

Other patents on exercise equipment include U.S. Pat. No. 5,308,302, issued to Samuel Miller, describing an arm exercising machine for a seated user; and U.S. Pat. No. 5,352,174, issued to Rradley R. Mason, describing an elastomeric tube configured to be used in a variety of shoulder strengthening exercises.

Other patents on devices for use with wheelchairs include U.S. Pat. No. 5,597,148, issued to James A. Gospodarich, describing a beverage container holder for a wheelchair; U.S. Pat. No. 5,651,558, issued to James A. Boyce, describing a wheelchair attachment allowing the occupant to perform a variety of different tasks; and U.K. Pat. App. No. 2,205,284 describing a spring-loaded independent suspension for a wheelchair.

None of the above inventions and patents, taken either singularly or in combination, is seen to describe the instant invention as claimed. Thus a combination arm exercise apparatus and propulsion aid for a wheelchair solving the aforementioned problems is desired.

SUMMARY OF THE INVENTION

The invention is an elongated, elastomeric member connected at one end to a wrist strap, and at the other end to a pivoting arm assembly attached above the footrest of a wheelchair. The invention will typically be used in pairs, with one apparatus on each side of a wheelchair.

The elongated, elastomeric member will usually be made from surgical tubing with a metal clip on each end, allowing easy installation and removal. The optimum level of resistance to stretching will vary based on the strength, endurance, and purpose of the user. Therefore, surgical tubing of different strengths can be selected by the user and interchanged as desired.

One end of the surgical tubing will fasten around the wrist with a fabric strap, secured around the wrist using hook and loop fasteners. The other end will fasten to a swing arm assembly attached to the front portion of the wheelchair, preferably above the footrest. The swing arm assembly comprises a pivoting arm and a fixed arm. The pivoting arm is movable between an inward position wherein it is directly in front of the wheelchair, and an outward position wherein it is extended outward towards the side of the wheelchair. In the inward position, nothing protrudes sideways beyond the wheels, so that the invention does not interfere with passing through doorways. In the outward position, the pivoting arm protrudes outward a sufficient distance so that the surgical tubing and wheelchair's rear wheels do not interfere with each other. The pivoting arm is spring-biased towards the inward position. Therefore, stretching the surgical tubing moves the arm to the outward position, and relaxing the surgical tubing allows the arm to return to the inward position.

Typically, pushing a wheelchair involves two arm motions: pulling the arms inward and rearward in preparation to push the rear wheels, and pushing the arms outward and forward while pushing the wheel. Pulling the arms inward and rearward uses three muscle groups: the biceps, trapezius, and latissimus dorsi. Pushing the wheel forward requires the three opposing muscle groups: The triceps, pectorals, and deltoids. Typically, pushing a wheelchair provides no resistance to pulling the arms rearward, but does provide moderate to heavy resistance to pushing the arms forward. Therefore, the triceps, pectorals, and deltoids are exercised extensively, while the biceps, trapezius, and latissimus dorsi get no exercise. The resulting imbalance between opposing muscle groups results in increased risk of injury.

When using the invention, pulling the arms back stretches the surgical tubing, providing exercise for the biceps, trapezius, and latissimus dorsi. The pivoting arm pivots to the outward position, avoiding interference with the rear wheel. As the user pushes the wheelchair forward, the surgical tubing retracts, assisting in pushing the wheel, and reducing the required exertion of the triceps, pectorals, and deltoids. The pivoting arm pivots inward as the surgical tubing retracts. By increasing the amount of exertion required of the muscle groups normally not exercised, while decreasing the amount of exertion on the muscle groups normally exerted extensively, the invention balances the level of exercise provided to the opposing muscle groups.

Accordingly, it is a principal object of the invention to provide an exercise apparatus for use in a wheelchair.

It is another object of the invention to provide a propulsion aid for a wheelchair.

It is a further object of the invention to balance the exertion of the opposing upper body muscle groups during use of a wheelchair.

Still another object of the invention is to provide an exercise and propulsion aid for a wheelchair which does not interfere with the other daily activities of a wheelchair user.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is an exercise apparatus and propulsion aid for a wheelchair user. The invention comprises an elongated elastomeric member attached at one end to a wrist strap, and at the other end to a swing arm assembly attached to the front of a wheelchair, preferably above the footrest.

Figure 4:
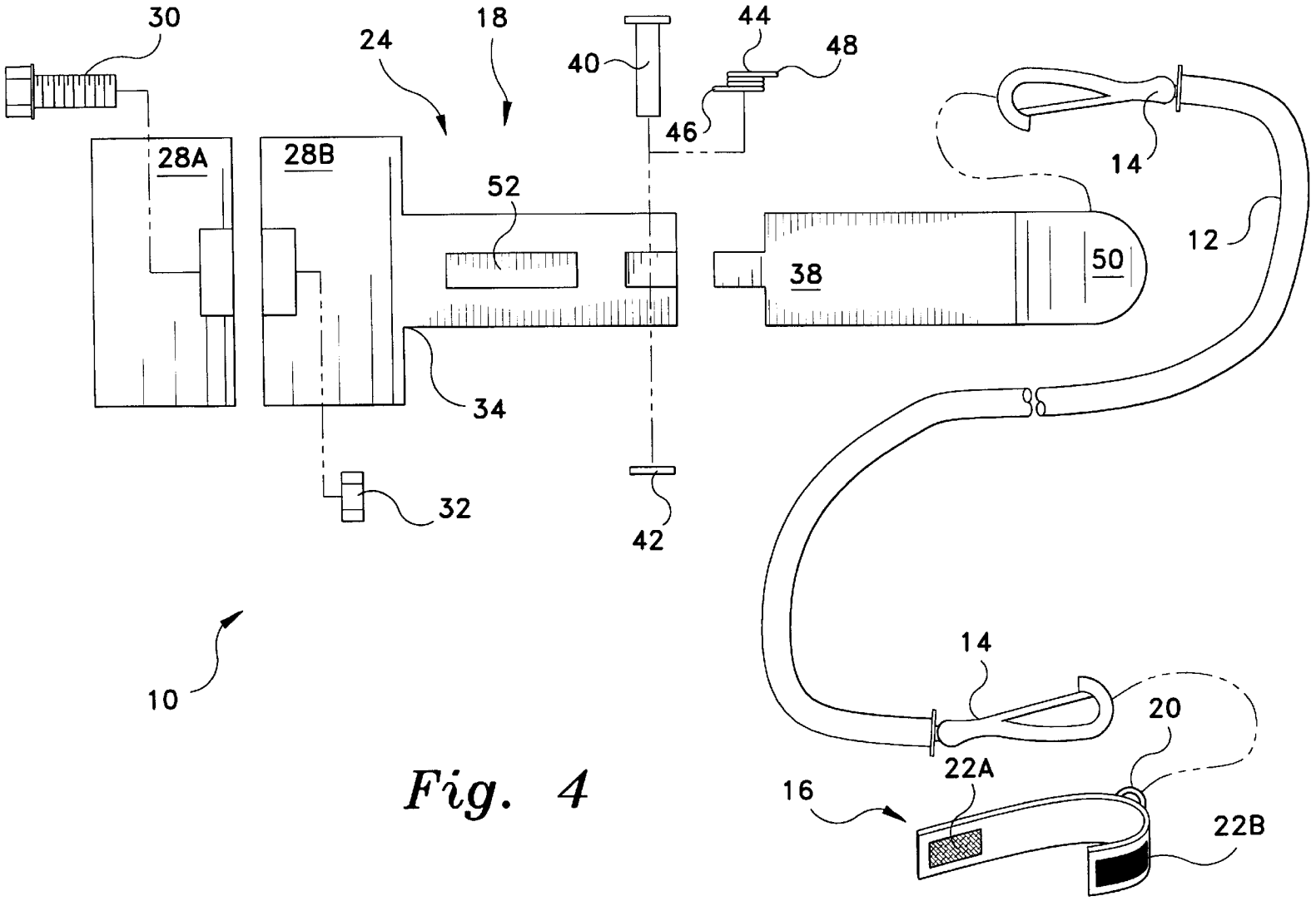
FIG. 4 is an exploded view of a combination arm exercise apparatus and propulsion aid for a wheelchair according to the present invention.

Referring to FIG. 4, the individual components of the invention 10 are shown. Elastomeric member 12, preferably made from surgical tubing, has metal clips 14 at each end. One of clips 14 attaches to wrist strap 16, and the other clip 14 attaches to swing arm assembly 18.

Wrist strap 16 includes D-ring 20, providing a place for clip 14 to attach. Wrist strap 16 also includes mating hook and loop fasteners 22*a*,22*b*, allowing wrist strap 16 to be adjusted for different diameter wrists.

Figure 3:
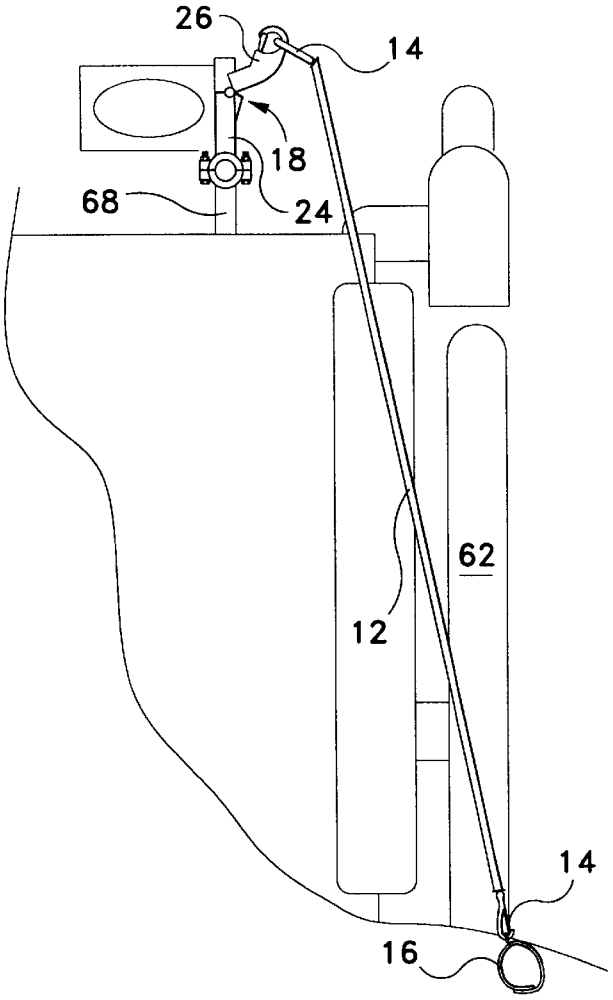
FIG. 3 is a fragmented top plan view of a combination arm exercise apparatus and propulsion aid for a wheelchair according to the present invention, showing the invention extended.
Figure 2:
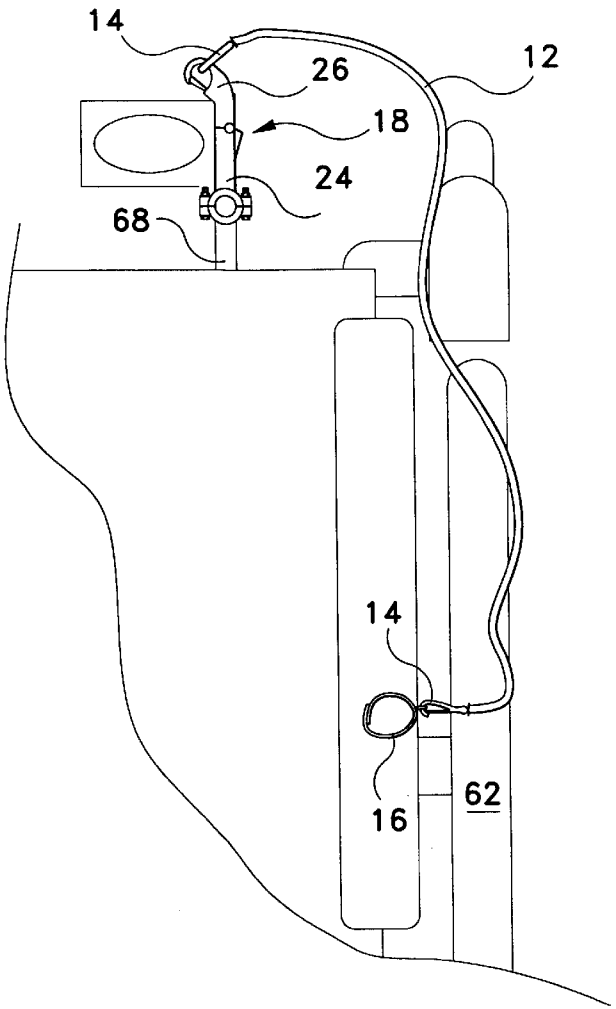
FIG. 2 is a fragmented top plan view of a combination arm exercise apparatus and propulsion aid for a wheelchair according to the present invention, showing the invention retracted.
Figure 5:
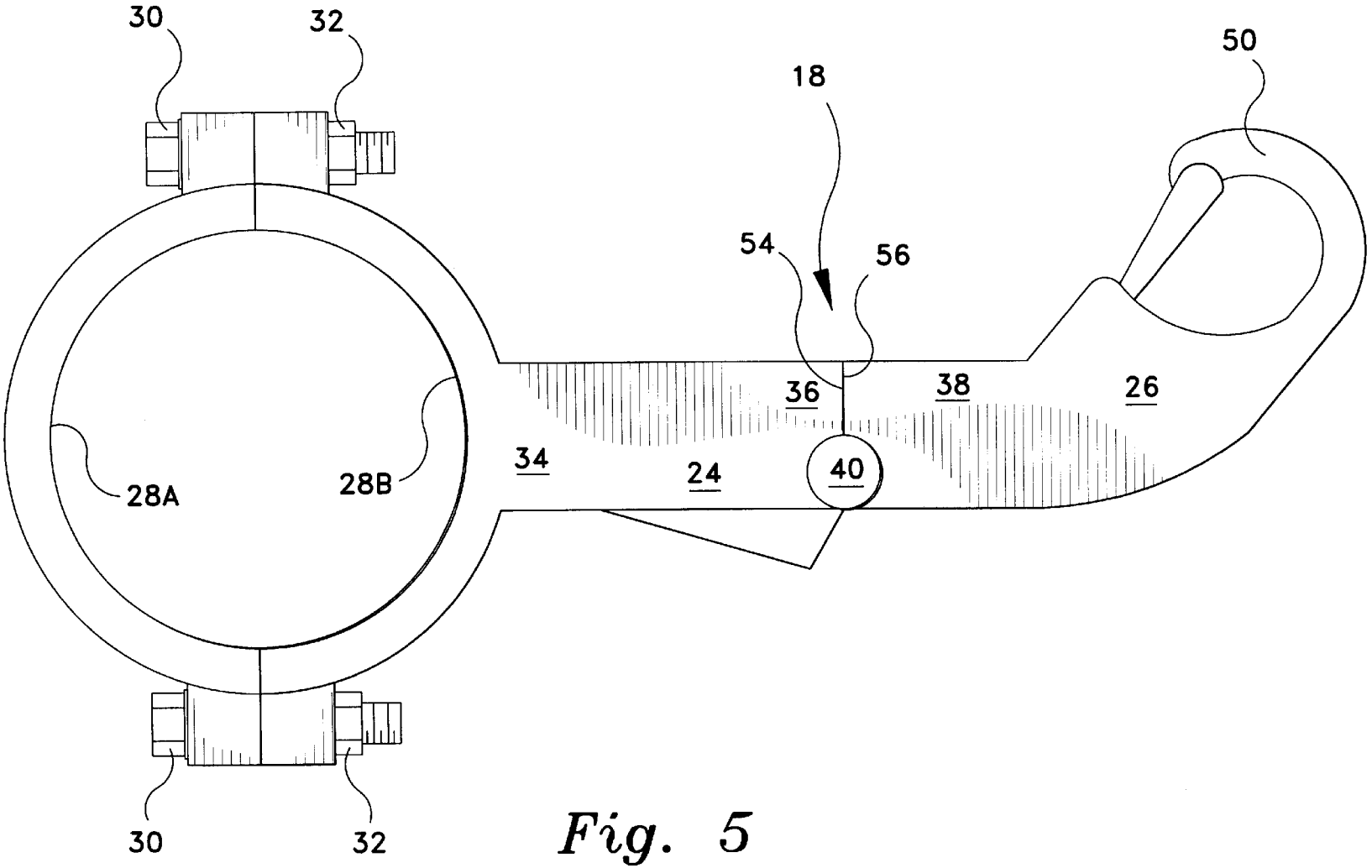
FIG. 5 is a top plan view of the swing arm assembly which attaches to the front of a wheelchair.

Referring to FIGS. 4 and 5, swing arm assembly 18 includes fixed arm 24 and pivoting arm 26. Fixed arm 24 is integrally attached at end 34 to mating collar portion 28*b*, which attaches to mating collar portion 28*a*. Bolts 30 pass through each side of mating collar portions 28*a*,28*b*, and are secured in place by nuts 32. End 36 of fixed arm 24 attaches to end 38 of pivoting arm 26. Pin 40 passes through end 36 of fixed arm 24, and end 38 of pivoting arm 26, thereby pivotally securing pivoting arm 26 to fixed arm 24. Retaining ring 42 fits over pin 40, securing pin 40 in place. Coil spring 44 fits around pin 40, with wire 46 adjacent to fixed arm 24 and wire 48 adjacent to pivoting arm 26. Coil spring 44 biases pivoting arm 26 in its inward position, wherein pivoting arm 26 and fixed arm 24 are in collinear arrangement, as seen in FIG. 2. End of pivoting arm 26 includes clip 50 for attaching clip 14 of surgical tube 12. Limit stop 52 is attached to fixed arm 24, positioned to lie adjacent to pivoting arm 26 when pivoting arm 26 is in its outward position, wherein pivoting arm 26 and fixed arm 24 are in angular relationship to one another, as seen in FIG. 3, the stop 52 thus preventing further outward rotation of pivoting arm 26. Mating surfaces 54,56 at ends 36,38 of the fixed arm 24 and pivoting arm 26 prevent movement beyond the inward position.

Figure 1:
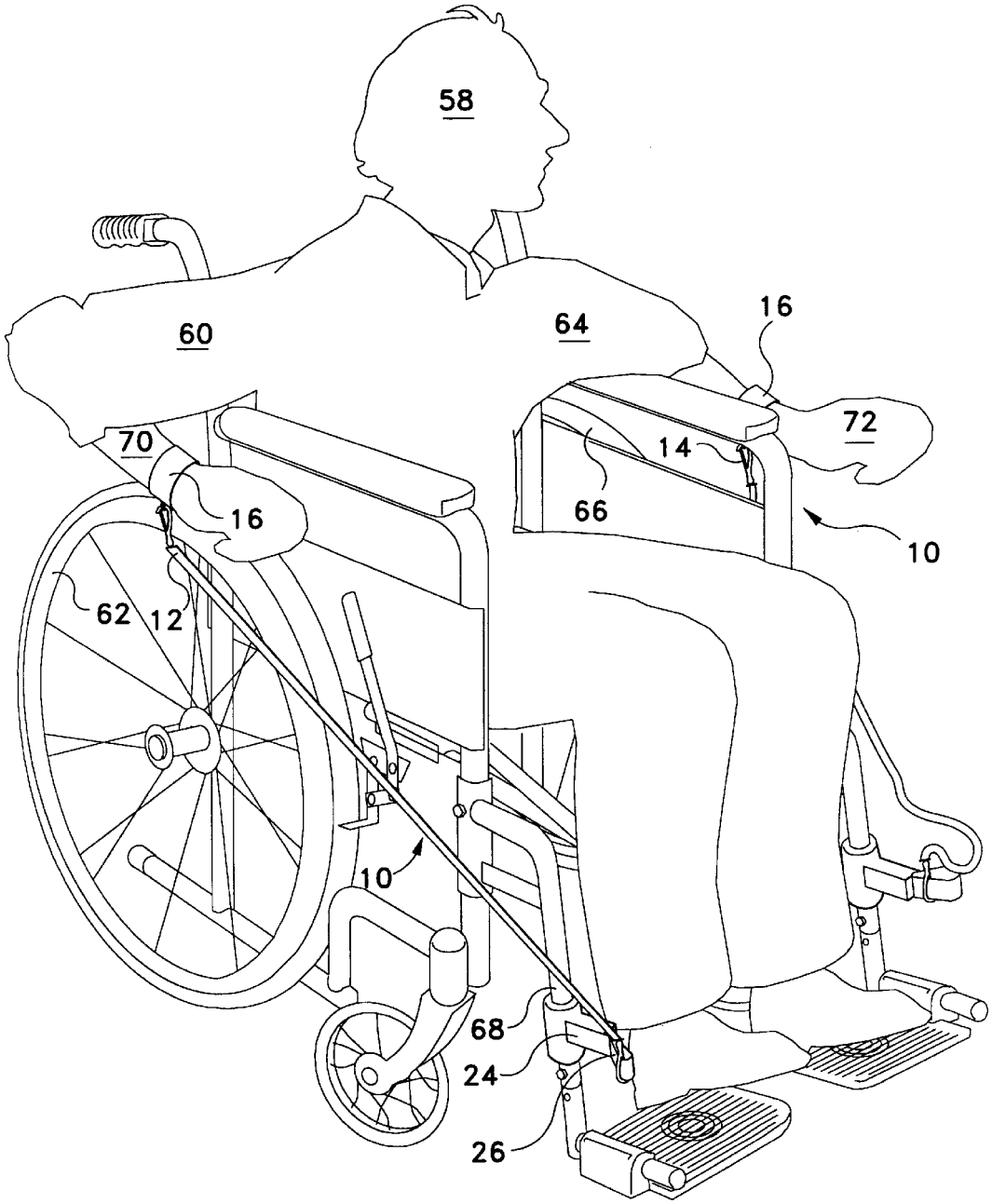
FIG. 1 is an environmental, perspective view of a combination arm exercise apparatus and propulsion aid for a wheelchair according to the present invention.

The invention's use is illustrated in FIGS. 1–3. In FIG. 1, wheelchair user 58 is using one exercise apparatus 10 for each arm. Mating collar portions 28*a*, 28*b* secure the swing arm assembly to footrest attachments 68, and wrist straps 16 are wrapped around the wrists 70,72 of user 58. Wheelchair user 58 has retracted right arm 60 in preparation to push right wheel 62. This action has stretched surgical tubing 12, and caused pivoting arm 26 to swing outward in a substantially horizontal plane. Referring briefly to FIG. 2, pivoting arm 26 has, by swinging outward, allowed surgical tubing 12 to remain clear of rear wheel 62. Stretching surgical tubing 12 has exercised three muscle groups: the biceps, the trapezius, and the latissimus dorsi.

Referring back to FIG. 1, left arm 64 has completed pushing left wheel 66 forward. As shown in FIG. 3, surgical tubing 12 is relaxed, and pivoting arm 26 has pivoted into its inward position. In this position, pivoting arm 26 will not interfere with passing through doorways. Pushing the wheel 66 exercises three muscle groups: the triceps, the pectorals, and the deltoids. However, the return of surgical tubing 12 to its resting length assists the arm of the user to move forward and thereby push wheel 66 forward, reducing the level of exertion required of these muscles. By increasing the level of exertion in the biceps, trapezius, and latissimus dorsi, and decreasing the level of exertion in the triceps, pectorals, and deltoids, the invention has balanced the levels of exertion in the opposing muscle groups.

Because surgical tubing 12 is attached by clips 14, surgical tubing 12 is easily removed and replaced with a different surgical tubing 12 having a different level of resistance to stretching. The ideal level of resistance will vary with the strength, endurance, and preferences of the user, and the duration of the use. Preferably, the invention will include several different interchangeable elastomeric members 12, as suggested by the broken length of tubing 12 shown in FIG. 4.

It is to be understood that the present invention is not limited to the embodiment described above, but encompasses any and all embodiments within the scope of the following claims.

I claim:

1. An arm exercise apparatus and propulsion aid for use with a wheelchair having a pair of rear wheels defining a pair of planes, and, a front portion, said arm exercise apparatus comprising:

an elongated, flexible, elastomeric member having a first end and a second end;

a wrist strap connected to said first end of said elastomeric member; and a swing arm assembly comprising:

a fixed arm having a first end and a second end, said first end for attaching to the front portion of a wheelchair;

a pivoting elongated arm having a first end and a second end, said first end attaching to said second end of said elastomeric member, said pivoting arm's second end being hingedly attached to said fixed arm's second end, said pivoting arm being pivotally movable between a first position wherein said pivoting arm and said fixed arm are in collinear arrangement and a second position wherein said pivoting arm is in angular relationship to said fixed arm; and a spring biasing said pivoting arm in said first position;

whereby when said swing arm is attached to the front portion of a wheelchair such that the swing arm is substantially collinear and confined between the planes defined by the rear wheels, the pivoting arm one of the planes defined by the rear wheels when said elastomeric member is stretched.

2. The combination arm exercise apparatus and propulsion aid for a wheelchair according to claim 1, wherein said elastomeric member is made from surgical tubing.

3. The combination arm exercise apparatus and propulsion aid for a wheelchair according to claim 1, further comprising a plurality of interchangeable elastomeric members.

4. The combination arm exercise apparatus and propulsion aid for a wheelchair according to claim 1, further comprising a clip on said first and second ends of said each of elastomeric member.

5. The combination arm exercise apparatus and propulsion aid for a wheelchair according to claim 1, wherein said wrist strap further comprises an elongated, flexible member having two ends, with mating hook and loop fasteners at each end.

6. The combination arm exercise apparatus and propulsion aid for a wheelchair according to claim 1, wherein said swing arm assembly further comprises a limit stop attached to said fixed arm, positioned to correspond to a predetermined maximum outward angular position of said pivoting arm.

7. An arm exercise apparatus and propulsion aid in combination with a wheelchair, said wheelchair having a pair of rear wheels defining a pair of planes, and a front portion, said arm exercise apparatus comprising:

an elongated, flexible, elastomeric member having a first end and a second end;

a wrist strap connected to said first end of said elastomeric member; and a swing arm assembly comprising:

a fixed arm having a first end and a second end, said first end attached to the front portion of a wheelchair;

a pivoting elongated arm having a first end and a second end, said first end attaching to said second end of said elastomeric member, said pivoting arm's second end being hingedly attached to said fixed arm's second end, said pivoting arm being pivotally movable between a first position wherein said pivoting arm and said fixed arm are in collinear arrangement and said swing arm is positioned substantially between the planes defined by said wheels, and, a second position wherein said pivoting arm is in angular relationship to said fixed arm, said pivoting arm crossing said plane of a proximate wheel; and a spring biasing said pivoting arm in said first position.

8. The combination arm exercise apparatus and propulsion aid and wheelchair according to claim 7, wherein said elastomeric member is made from surgical tubing.

9. The combination arm exercise apparatus and propulsion aid and wheelchair according to claim 7, further comprising a plurality of interchangeable elastomeric members.

10. The combination arm exercise apparatus and propulsion aid and wheelchair according to claim 7, further comprising a clip on each of said first and second ends of said elastomeric member.

11. The combination arm exercise apparatus and propulsion aid and wheelchair according to claim 7, wherein said wrist strap further comprises an elongated, flexible member having two ends, with mating hook and loop fasteners at each end.

12. The combination arm exercise apparatus and propulsion aid and wheelchair according to claim 7, wherein said swing arm assembly further comprises a limit stop attached to said fixed arm, positioned to correspond to a predetermined maximum outward angular position of said pivoting arm.

13. The combination arm exercise apparatus and propulsion aid and wheelchair according to claim 12, wherein said pivoting arm of said swing arm assembly pivots in a substantially perpendicular plane relative to said planes of said wheels.

14. An arm exercise apparatus and propulsion aid for use with a wheelchair, the wheelchair having a pair of rear wheels defining a pair of planes, and, a front portion forward of the rear wheels, said arm exercise apparatus comprising:

an elongated, flexible, elastomeric member having a first end and a second end;

means for removably connecting said first end of said elastomeric member to a wrist of a wheelchair user; and means for attaching said elastomeric member to the front portion and positioning said elastomeric member such that said elastomeric member when stretched lies substantially outside of the pair of planes and free of interference with the wheels; wherein said means for attaching and positioning said elastomeric member is a swing arm assembly comprising:

a fixed arm having a first end and a second end, said first end for attaching to the front portion of a wheelchair;

a pivoting elongated arm having a first end and a second end, said first end attaching to said second end of said elastomeric member, said pivoting arm's second end being hingedly attached to said fixed arm's second end, said pivoting arm being pivotally movable between a first position wherein said pivoting arm and said fixed arm are in collinear arrangement and a second position wherein said pivoting arm is in angular relationship to said fixed arm; and a spring biasing said pivoting arm in said first position;

whereby when said swing arm is attached to the front portion of a wheelchair such that the swing arm is substantially collinear and confined between the planes defined by the rear wheels, the pivoting arm crosses one of the planes defined by the rear wheels when said elastomeric member is stretched.

15. The combination arm exercise apparatus and propulsion aid for a wheelchair according to claim 14, wherein said elastomeric member is made from surgical tubing.

16. The combination arm exercise apparatus and propulsion aid for a wheelchair according to claim 14, further comprising a plurality of interchangeable elastomeric members.

17. The combination arm exercise apparatus and propulsion aid for a wheelchair according to claim 14, further comprising a clip on said first and second ends of said elastomeric member.

18. The combination arm exercise apparatus and propulsion aid for a wheelchair according to claim 14, wherein said means for connecting is a wrist strap comprising an elongated, flexible member having two ends, with mating hook and loop fasteners at each end.

19. The combination arm exercise apparatus and propulsion aid for a wheelchair according to claim 14, wherein said swing arm assembly further comprises a limit stop attached to said fixed arm, positioned to correspond to a predetermined maximum outward angular position of said pivoting arm.

* * * * *